US008033152B2

(12) United States Patent
Prevey III

(10) Patent No.: US 8,033,152 B2
(45) Date of Patent: Oct. 11, 2011

(54) METALLIC ARTICLE WITH IMPROVED FATIGUE PERFORMANCE AND CORROSION RESISTANCE

(75) Inventor: Paul S. Prevey III, Cincinnati, OH (US)

(73) Assignee: Surface Technology Holdings, Ltd., Cincinnati, OH (US)

( * ) Notice: Subject to any disclaimer, the term of this patent is extended or adjusted under 35 U.S.C. 154(b) by 0 days.

(21) Appl. No.: 12/802,623

(22) Filed: Jun. 10, 2010

(65) Prior Publication Data

US 2010/0248003 A1 Sep. 30, 2010

Related U.S. Application Data

(62) Division of application No. 11/435,072, filed on May 16, 2006, now Pat. No. 7,762,113.

(51) Int. Cl.
*B24B 39/00* (2006.01)
*B32B 15/01* (2006.01)
*C21D 7/06* (2006.01)

(52) U.S. Cl. ..... 72/53; 29/90.1; 428/642; 428/649; 428/650

(58) Field of Classification Search ..... 428/617, 428/642, 648, 649, 650.902; 29/90.01, 90.3, 29/90.5, 615; 72/53
See application file for complete search history.

(56) References Cited

U.S. PATENT DOCUMENTS

| | | | | |
|---|---|---|---|---|
| 541,467 | A | | 6/1895 | Brown |
| 921,641 | A | | 5/1909 | Cumberland |
| 1,335,210 | A | | 3/1920 | Von Wurstemberger |
| 1,827,247 | A | | 10/1931 | Mason |
| 1,961,752 | A | | 6/1934 | Fink et al. |
| 3,102,086 | A | | 8/1963 | Cotton |
| 3,357,458 | A | * | 12/1967 | Radd et al. ..... 72/53 |
| 4,086,104 | A | * | 4/1978 | Kinoshita et al. ..... 72/53 |
| 4,606,890 | A | | 8/1986 | Fisk |
| 4,752,368 | A | | 6/1988 | Wasson |
| 5,311,652 | A | * | 5/1994 | McConkey et al. ..... 72/53 |
| 5,782,194 | A | | 7/1998 | Tipton |
| 6,235,409 | B1 | | 5/2001 | Serafin et al. |
| 6,325,138 | B1 | | 12/2001 | Garosshen et al. |
| 6,415,486 | B1 | * | 7/2002 | Prevey, III ..... 29/90.01 |
| 6,551,491 | B2 | | 4/2003 | Dowling et al. |

(Continued)

OTHER PUBLICATIONS

Nimmo, Bill ed., "Corrosion Control Checklist," 2001, National Physical Laboratory (UK).

(Continued)

*Primary Examiner* — David B Jones
(74) *Attorney, Agent, or Firm* — Mark F. Smith; Smith Brandenburg Ltd

(57) ABSTRACT

A metallic article with improved fatigue performance and resistance to corrosive attack and stress corrosion cracking is produced by treating a first area of a metallic article with a first surface treatment that induces a specified amount of cold work. A second, sacrificial area of the metallic article in electrical communication with the first area is treated with a second surface treatment that induces an amount of cold work higher than that of the first surface treatment. Due to the differences in cold work resulting from the different surface treatments, the second area of the metallic article is less noble than the first area and is therefore more susceptible to corrosive attack. As a result, the second sacrificial area will preferentially corrode leaving the first area protected from corrosive attack. Compressive residual stresses induced in the surface of the metallic article through the surface treatments improve the fatigue performance and resistance to stress corrosion cracking.

12 Claims, 5 Drawing Sheets

U.S. PATENT DOCUMENTS

| | | | | |
|---|---|---|---|---|
| 6,578,628 | B1 | 6/2003 | Garosshen | |
| 6,673,469 | B2 | 1/2004 | Isaccsson et al. | |
| 6,684,617 | B2 | 2/2004 | Longaygue et al. | |
| 6,926,970 | B2 * | 8/2005 | James et al. | 428/615 |
| 7,188,398 | B2 * | 3/2007 | Prevey | 29/90.01 |
| 7,762,113 | B2 * | 7/2010 | Prevey, III | 72/53 |

OTHER PUBLICATIONS

Cottis, R.A. ed., "Guides to Good Practice in Corrosion Control: Stress Corrosion Crakcing," 2000, National Physical Laboratory (UK).

Prevey, Paul et al., "Mechanical Suppression of SCC and Corrosion Fatigue Failures in 300M Steel Landing Gear," Proceedings of ASIP 2004, Nov. 29-Dec. 2, 2004, ASIP (USA).

Jayaraman, N. et al., Comparision of Mechanical Suppression by Shot Peening and Low Plasticity Burnishing to Mitigate SCC and Corrosion Fatigue Failures in 300M Landing Gear.

Steel, Proceedings of the International Conference on Shot Peening, Paris, Marne la Vallee, France, Sep. 6-9, 2005.

Sartwell, B.D. et al., "Replacement of Chromium Electroplating Using HVOF Thermal Spray Coatings".

Davies, K.G. et al., "Cathodic Protection," 1981, National Physical Laboratory, (UK).

Office Action, U.S. Appl. No. 11/435,072, filed May 16, 2006, Date of Office Action Oct. 23, 2009.

* cited by examiner

FIG 1. Anodic Polarization Curves For 7075-T6 Aluminum Samples in 3.5 wt.% NaCl Solution FIG 2. Open Circuit Potential vs. Cold Work for 7075 T6 Aluminum in 3.5 wt.% NaCl Solution

METALLIC ARTICLE WITH IMPROVED FATIGUE PERFORMANCE AND CORROSION RESISTANCE

RELATED PATENT APPLICATIONS

This application is a divisional application of U.S. patent application Ser. No. 11/435,072, filed May 16, 2006 now U.S. Pat. No. 7,762,113, entitled METALLIC ARTICLE WITH IMPROVED FATIGUE PERFORMANCE AND CORROSION RESISTANCE AND METHOD FOR MAKING THE SAME and has the same inventor in common.

BACKGROUND OF THE INVENTION

This invention generally relates to protecting metals from corrosive attack and, more specifically, to a metallic article with improved resistance to corrosion, fatigue, corrosion fatigue and stress corrosion cracking.

A variety of techniques are currently employed to mitigate or eliminate the occurrence of corrosion and corrosion damage. This includes the incorporation of additional metal in the design of a component, the redesign of components to incorporate alloys less susceptible to corrosive attack, the environmental isolation of corrosion-susceptible surfaces with paints, coatings or plating, and the modification of the electro-chemical processes responsible for corrosion.

When it is anticipated that a component will be exposed to a corrosive environment, additional metal may be incorporated in the design to account for the loss of material due to corrosion. This technique does nothing to alter or mitigate the rate at which the component corrodes but rather delays the ultimate failure of the component due to corrosion by the addition of material. As such, this technique is not well suited to applications where component weight is a critical design factor.

If, after deployment, a component is found to be particularly susceptible to corrosion, the component may be withdrawn from service and redesigned utilizing a different material that is more resistant to corrosive attack. However, the redesign of a component is often a costly proposition resulting in the duplication of engineering efforts and equipment downtime and is therefore undesirable.

Another, more common technique to prevent or mitigate corrosion is the application of paints, plating or other types of coatings to the corrosion prone surface. The coatings isolate the surface of the component from the corrosive environment and block the flow of electrons between cathodic regions and anodic regions thereby extinguishing the electro-chemical processes responsible for corrosion. For painting or coating, a variety of non-reactive materials may be used. Paint and coating materials may contain solvents and other toxic chemicals creating a health and environmental hazard in the application and removal of the paint or coating.

Plating provides a more durable coating than do paints and other types of coatings. In plating, corrosion resistant metals such as cadmium or chromium have been commonly used to treat corrosion susceptible surfaces. However, cadmium and chromium plating materials present significant health and environmental risks and plating techniques using these materials are being phased out. Further, while the mechanical barrier produced by coating and plating offers significant protection against corrosion, these treatments are susceptible to damage and require periodic maintenance or reapplication. If the coating barrier is penetrated, the underlying metal is exposed to the corrosive environment and corrosion begins to occur. Coatings used on surfaces susceptible to wear, such as the struts on aircraft landing gear, need to be regularly maintained or replaced in order to provide the proper protection to the underlying structure. Such maintenance is time consuming and expensive and may have undesirable health and environmental risks due to the nature of the materials involved.

Cathodic protection systems seek to control the rate of corrosion of a material by altering the corrosion potential of the metal. Cathodic protection of a metal may be obtained by introducing a current in the material that counteracts the normal electro-chemical reactions responsible for corrosion. Several techniques may be used to cathodically protect a metallic article susceptible to corrosive attack including galvanic coatings, impressed currents/solid state coatings, and external current supplied to the surface to be protected. Of these techniques, galvanic coatings or galvanic couples are commonly used to protect a metallic article from corrosive attack by providing a sacrificial material, in the form of a coating or feature, that will preferentially corrode leaving the metallic article protected. Galvanic protection operates by creating a potential difference between two or more areas in electrical contact with one another. The potential difference causes a current to flow between the areas. This current is designed to counteract an existing corrosion current thereby extinguishing the corrosion reaction at the surface to be protected and promoting corrosion at the sacrificial coating or feature. A galvanic couple is obtained by placing two electrochemically dissimilar metals in electrical contact with one another. The metal with the lower corrosion potential, i.e. the metal that is more susceptible to corrosive attack, is comparatively less noble and will preferentially corrode leaving the other metal protected from corrosive attack. The protected metal has a higher corrosion potential relative to the preferentially corroding metal, and is therefore more noble and less susceptible to corrosive attack.

In addition to the deterioration of a metallic surface by corrosion processes, corrosion or exposure to a corrosive environment may also lead to the premature failure of metallic components. Metallic components subject to continued cyclic loading are prone to fatigue failure. The fatigue life of a component may be significantly shortened by exposure to a corrosive environment. This is due to the fact that damage to the surface of a component as a result of corrosion, such as pitting or inter-granular corrosion, acts as a stress riser or stress concentrator and provides an ideal location for the initiation of fatigue cracks. Fatigue in the presence of corrosion is sometimes referred to as corrosion fatigue.

Further, certain metals are also susceptible to stress corrosion or environmentally assisted cracking. Stress corrosion cracking, or SCC, occurs when a susceptible metal is placed in a corrosive environment and subjected to stress, which may be applied, residual, static or cyclic. Beyond a certain threshold value of stress, stress corrosion cracks develop. The onset of stress corrosion cracking may begin suddenly with little or no prior evidence of material loss due to corrosion. Further, once formed, stress corrosion cracks can lead to mechanical fast fracture causing the sudden and catastrophic failure of a metallic component.

To mitigate component failure due to the conjoint effects of stress and corrosion, it is common to introduce compressive residual stresses in the surface of the metallic component to offset applied or residual tensile stresses. A common practice has been to shot peen the surface of the component to introduce a shallow layer of compressive stress. Alternatively, compressive residual stresses may be introduced in the surface of the component by burnishing, deep rolling, laser shock peening, indenting, or controlled impact peening to obtain greater uniformity and depth of the compressive residual stresses introduced in the component as compared to the random nature of shot peening.

While the use of compressive residual stresses is known to mitigate the effects of stress corrosion cracking, compressive residual stresses do not mitigate or prevent the gross corrosion of the metallic surface. To prevent gross corrosion of a metallic article, it is necessary to rely on the anti-corrosion techniques discussed above. Therefore, for parts susceptible to stress related failure and gross corrosion, it may be necessary to utilize a combination of anti-corrosion techniques and compressive residual stresses to mitigate the effects of each failure mechanism.

Accordingly, a need exists for an inexpensive, environmentally safe and easily incorporated method for producing metallic articles with reduced susceptibility to corrosive attack and improved resistance to fatigue, corrosion fatigue and stress corrosion cracking without requiring the use of additional materials or components.

SUMMARY OF THE INVENTION

The present invention addresses the need for an inexpensive, environmentally safe and easily incorporated method for producing metallic articles with enhanced fatigue, corrosion fatigue, and stress corrosion cracking performance and reduced susceptibility to corrosive attack. The article of the present invention is produced by a method using surface treatments to alter the corrosive susceptibility of a metal. A first area of a metallic article susceptible to cracking due to corrosion is treated with a first surface treatment that induces a specified amount of cold work. A second, sacrificial area of the metallic article in electrical communication with the first area is treated with a second surface treatment that induces an amount of cold work higher than that of the first surface treatment. It has now been unexpectedly found that, due to the difference in cold work resulting from the different surface treatments, the second area of the metallic article is less noble than the first area and is therefore more susceptible to corrosive attack. As a result, the second sacrificial area will preferentially corrode leaving the first area protected from corrosive attack thereby mitigating the effects of corrosion damage on the fatigue life of the component. Compressive residual stresses induced by the surface treatments provide the metallic article with improved fatigue performance and mitigate stress corrosion cracking.

In one embodiment, a galvanic couple, similar to a galvanic couple, is created between the first area and the second, sacrificial area through the use of surface treatments. The couple provides galvanic protection to the first protected area while causing the second, sacrificial area to preferentially corrode.

In another embodiment, burnishing, low plasticity burnishing, deep rolling, laser shock peening, shot peening, controlled impact peening, pinch peening, cavitation peening and/or indenting, or combinations thereof, are used to induce compressive residual stresses with a controlled amount of cold working in the first and second areas thereby altering the corrosive susceptibility of the material in a controlled manner.

In another embodiment, the first area of the metallic article is subject to high stress and susceptible to fatigue failure and/or stress corrosion cracking while the second, sacrificial area is not susceptible to either fatigue failure or stress corrosion cracking. Compressive residual stresses induced by the first surface treatment offset the stresses acting on the first area thereby improving the fatigue and/or stress corrosion cracking performance.

In another embodiment, the first area of the metallic article is more susceptible to fatigue failure and/or stress corrosion cracking than the second, sacrificial area. Compressive residual stresses introduced by the first and second surface treatments improve the resistance of the metallic article to both fatigue failure and stress corrosion cracking.

In another embodiment, the second, sacrificial area is designed to be a sacrificial feature that preferentially corrodes.

In another embodiment, the second, sacrificial area comprises an amount of extra material such that corrosion of the second, sacrificial area will not adversely impact the strength and integrity of the metallic article.

In another embodiment, the corrosion protection for the metallic article is renewed by removing corrosion products from the surface of the second, sacrificial area and repeating the surface treatment on the second, sacrificial area.

In another form, the present invention is a metallic article with improved resistance to corrosion, corrosion fatigue, fatigue, and stress corrosion cracking.

In one embodiment, the metallic article has a first area having compressive residual stress and an associated amount cold of work induced therein, and a second area having compressive residual stress and an associated amount of cold work induced therein, the amount of cold work in the second area being greater than the amount of cold work in the first area such that the first area is more noble and less susceptible to corrosive attack than the second area.

In another embodiment, the first area of the metallic article is susceptible to fatigue and/or stress corrosion cracking while the second area is not susceptible to fatigue or stress corrosion cracking.

In another embodiment, the first area of the metallic article is more susceptible to fatigue and/or stress corrosion cracking than the second area of the metallic article.

In another embodiment, the compressive residual stresses in the metallic article improve the resistance of the article to fatigue, corrosion fatigue and stress corrosion cracking.

In another form, the present invention is a battery utilizing the method of the present invention to generate the potential difference between the electrodes of the battery. The battery consists of metallic plates treated according to the method of the present invention and arranged in the presence of an electrolyte such that a potential difference develops across the arrangement.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
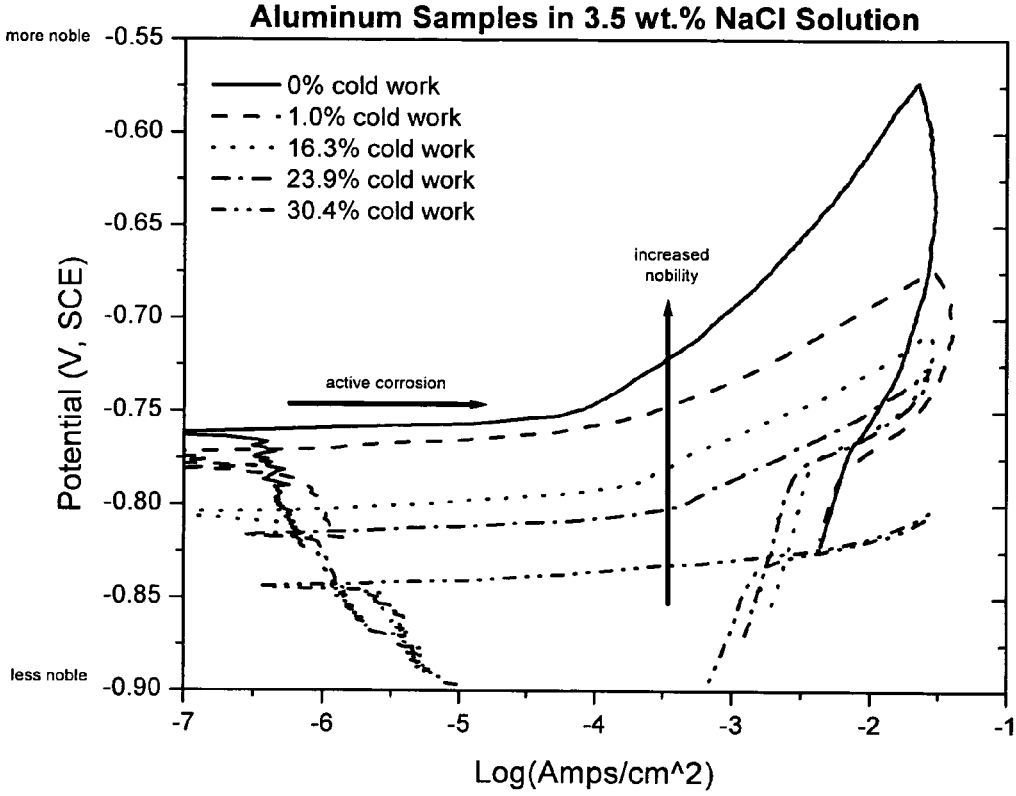
FIG. 1 is a graph showing a series of polarization curves for 7075-T6 aluminum samples with varying degrees of cold work in a 3.5 wt. % salt-water solution. The corrosion potential is in reference to a standard calomel electrode (SCE). Samples with low cold work (or no cold work as is the case with electro-polished samples) exhibit more noble behavior than samples with high cold work.

Galvanic protection or cathodic protection is one method often used to protect a metallic article from corrosive attack. In order to provide galvanic protection to a metallic article, the article is brought into electrical contact with an electro-chemically dissimilar metal. The metals are electro-chemically dissimilar in that one has a lower open circuit potential, also referred to as corrosion potential, than the other. The metal with the lower corrosion potential is more susceptible to corrosion (less noble) while the metal with the higher corrosion potential is less susceptible to corrosion (more noble).

When the dissimilar metals are brought into contact with one another, a galvanic couple is formed. With the addition of an electrolyte, such as saltwater, a corrosion reaction takes place in which the less noble metal acts as an anode and the more noble metal acts as a cathode. An oxidation reaction occurs at the surface of the less noble metal which supplies electrons to a reduction reaction taking place at the more noble metal, thus establishing a corrosion current between the electro-chemically dissimilar metals. As a result, the corrosion rate of the less noble metal is accelerated while the corrosion rate of the more noble metal is attenuated or completely mitigated. Therefore, the more noble metal is galvanically or cathodically protected from corrosive attack while the less noble metal is left to intentionally and sacrificially corrode.

Galvanic protection is commonly used to protected structural steels against corrosive attack. A galvanic couple is formed between the steel and an electro-chemically dissimilar zinc coating. The zinc is less noble than the steel and thus preferentially and sacrificially corrodes in the presence of a corrosive electrolyte while the underlying steel structure is protected.

It has now been unexpectedly found that a galvanic couple can be created in a single material utilizing surface treatments to bring about the necessary electro-chemical dissimilarity. In addition to providing galvanic protection against corrosion, the present invention also improves the fatigue properties and resistance to stress corrosion cracking of a metallic article.

The present invention utilizes surface treatments to locally alter the electro-chemical properties of a material and thereby create a galvanic couple to protect a particular area of a component from corrosive attack. Surface treatments, such as shot peening, burnishing, deep rolling, laser shock peening, and indenting, introduce compressive residual stress in the surface of the metallic article. The introduction of compressive residual stress is known to improve the fatigue performance and stress corrosion cracking properties of metallic materials. In addition to providing the treated material with beneficial compressive residual stress, the aforementioned surface treatments are also known to cold work the material as a result of the surface treatment operation. It is well recognized that the introduction of high amounts of cold work beneficially impacts the strength of the treated material. However, as disclosed in U.S. Pat. No. 5,826,453, it has been established that maintaining low levels of cold work during the introduction of compressive residual stress improves the thermal and mechanical stability of the induced residual stress.

It has now been unexpectedly found that the resistance of a material to corrosive attack can be controlled by altering the amount of cold work contained in the material. More specifically, it has been found that, for a given metallic material, samples having a high amount of cold work have are more susceptible to corrosive attack and are therefore less noble than samples of the same material that have a lower amount of cold work or are not cold worked at all, such as when the samples are electro-polished. This behavior is graphically illustrated by the polarization curves shown in FIG. 1 for a series of 7075-T6 aluminum samples with varying degrees of cold work. The data shows that sample materials having lower cold work have a higher (less negative) corrosion potential and, therefore, are less susceptible to corrosive attack than samples with higher amounts of cold work. Therefore, relative to the high cold worked samples, the lower cold worked samples are more noble and are less susceptible to corrosive attack while the higher cold worked samples are less noble and are more susceptible to corrosive attack.

Figure 2:
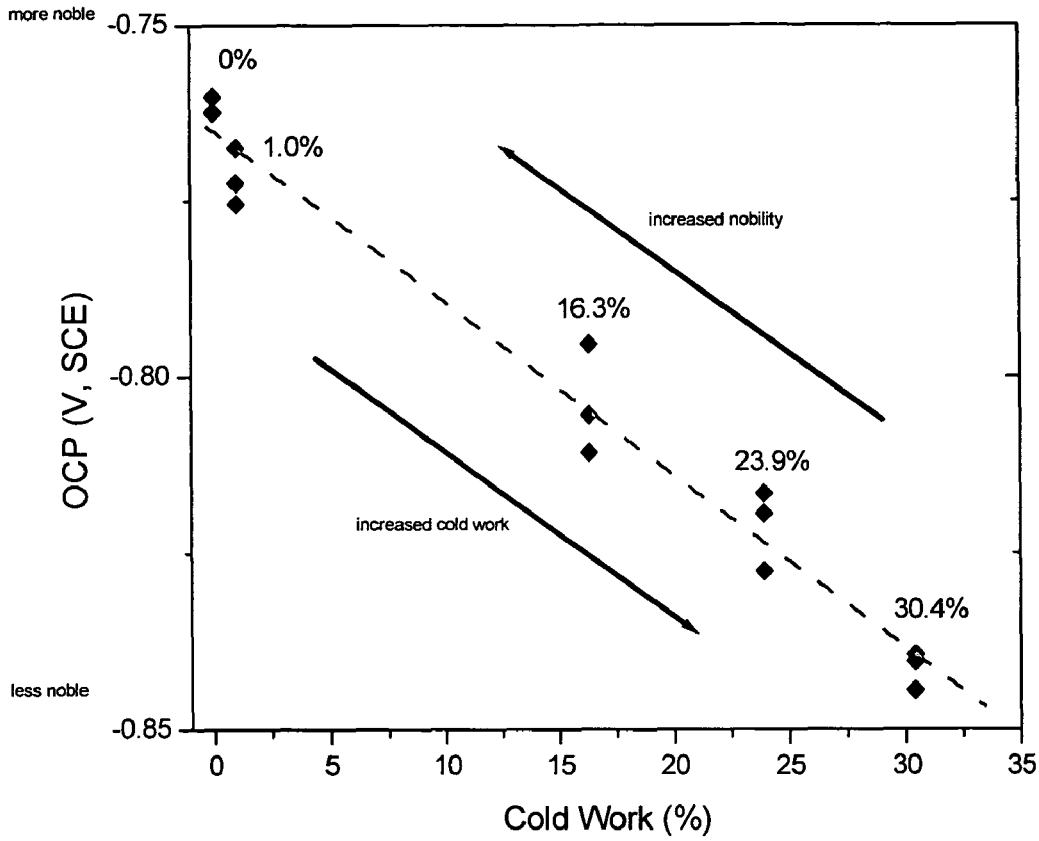
FIG. 2 is a graph showing the change in the open circuit potential (OCP) or free corrosion rate as a function of the amount of cold work for 7075-T6 aluminum samples in a 3.5% salt-water solution. The corrosion potential is in reference to a standard calomel electrode (SCE). Sample materials with no or low cold work have higher corrosion potentials, and are therefore more noble and more resistant to corrosive attack, than sample materials having higher amounts of cold work.

This behavior is further illustrated in FIG. 2 which shows the corrosion potential for 7075-T6 aluminum samples in a 3.5 wt. % sodium chloride-water solution as a function of the percent cold work contained in the sample at the open circuit potential. When exposed to the same corrosive environment, sample materials having relatively low cold work have a higher corrosion potential and are more noble (less susceptible to corrosion) than sample materials having higher cold work.

Figure 3:
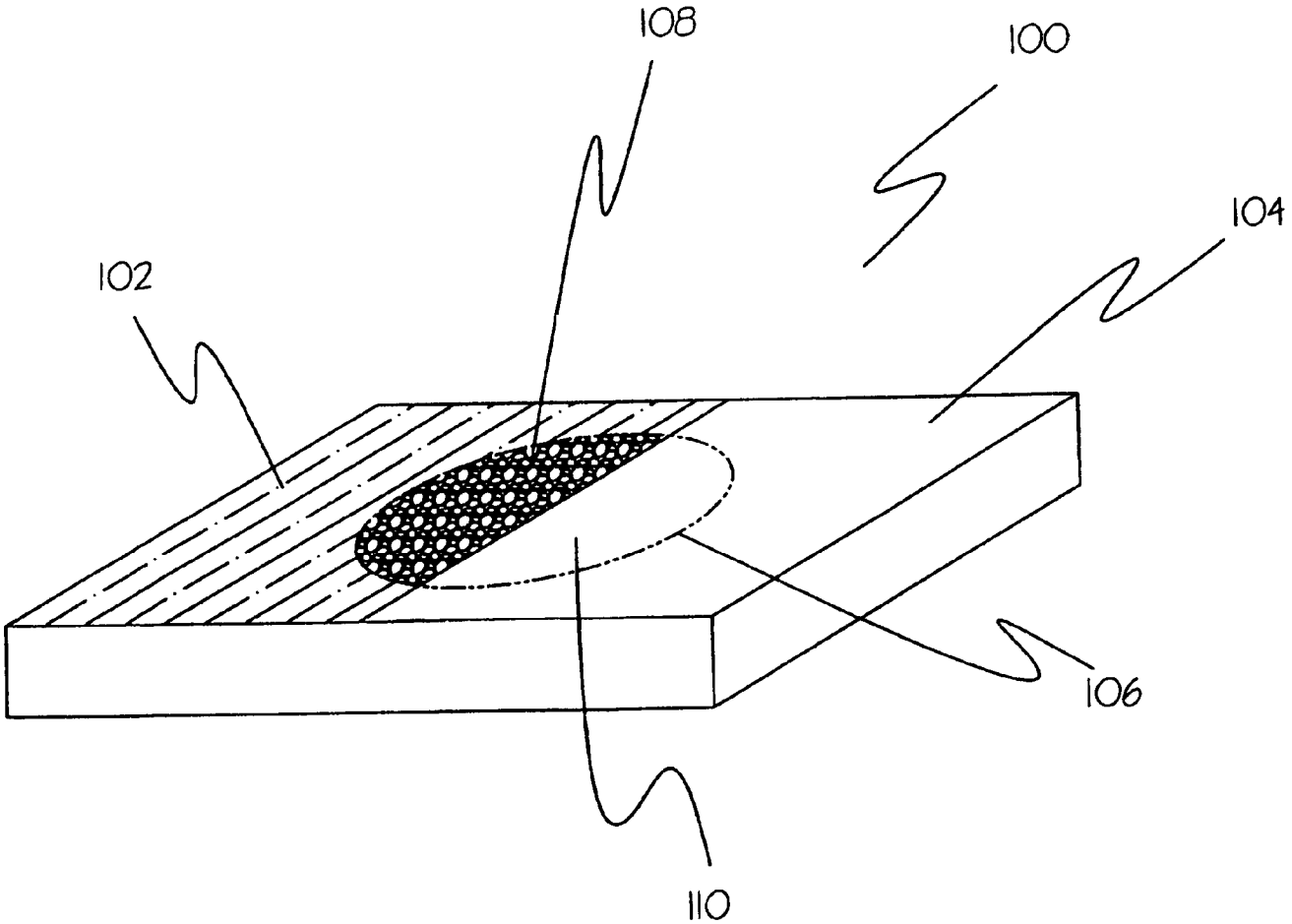
FIG. 3 is a perspective view of a 7075-T6 aluminum sample coupon treated according to the method of the present invention and exposed to corrosive, 3.5% salt-water solution. The higher cold worked areas exhibited corrosion damage, such as pitting, while the low cold worked area passivated and remained free from corrosion damage.

Accordingly, in one embodiment, the method of the present invention utilizes the differences in corrosion potential due to different amounts of cold work in a single material to create a galvanic couple such that a specific area of the metal with higher cold work sacrificially corrodes while another area with lower cold work is protected. Referring to FIG. 3, a rectangular 7075-T6 aluminum test sample 100 is schematically illustrated. One half of the top surface of the sample 100 has been heavily shot peened 102 resulting in approximately 30% cold work at the surface. The other half of the sample 100 has been treated with low plasticity burnishing 104 leaving the sample with 1% cold work at the surface. A test area 106 was then subjected to a controlled exposure in a 3.5 wt. % sodium chloride-water solution. In the test area 106, the higher cold worked surface 102 exhibited corrosion damage 108 while the lower cold worked surface 110 remained free from corrosive attack.

The behavior observed in the test sample 100 shown in FIG. 3 is a result of the differing corrosion potentials of the treated areas due to the amount of cold work contained in each. Because the lower cold worked area 104 has a higher corrosion potential than that of the area with higher cold work 102, the higher cold worked area 102 is more susceptible to corrosion and, therefore, preferentially corrodes instead of the lower cold worked area 104. As with the above referenced example of the galvanized steel, a galvanic couple is created between the higher cold work 102 and lower cold work 104 areas thereby affording galvanic or cathodic protection to the lower cold worked area 104 while the higher cold work area 102 preferentially or sacrificially corrodes.

Figure 4:
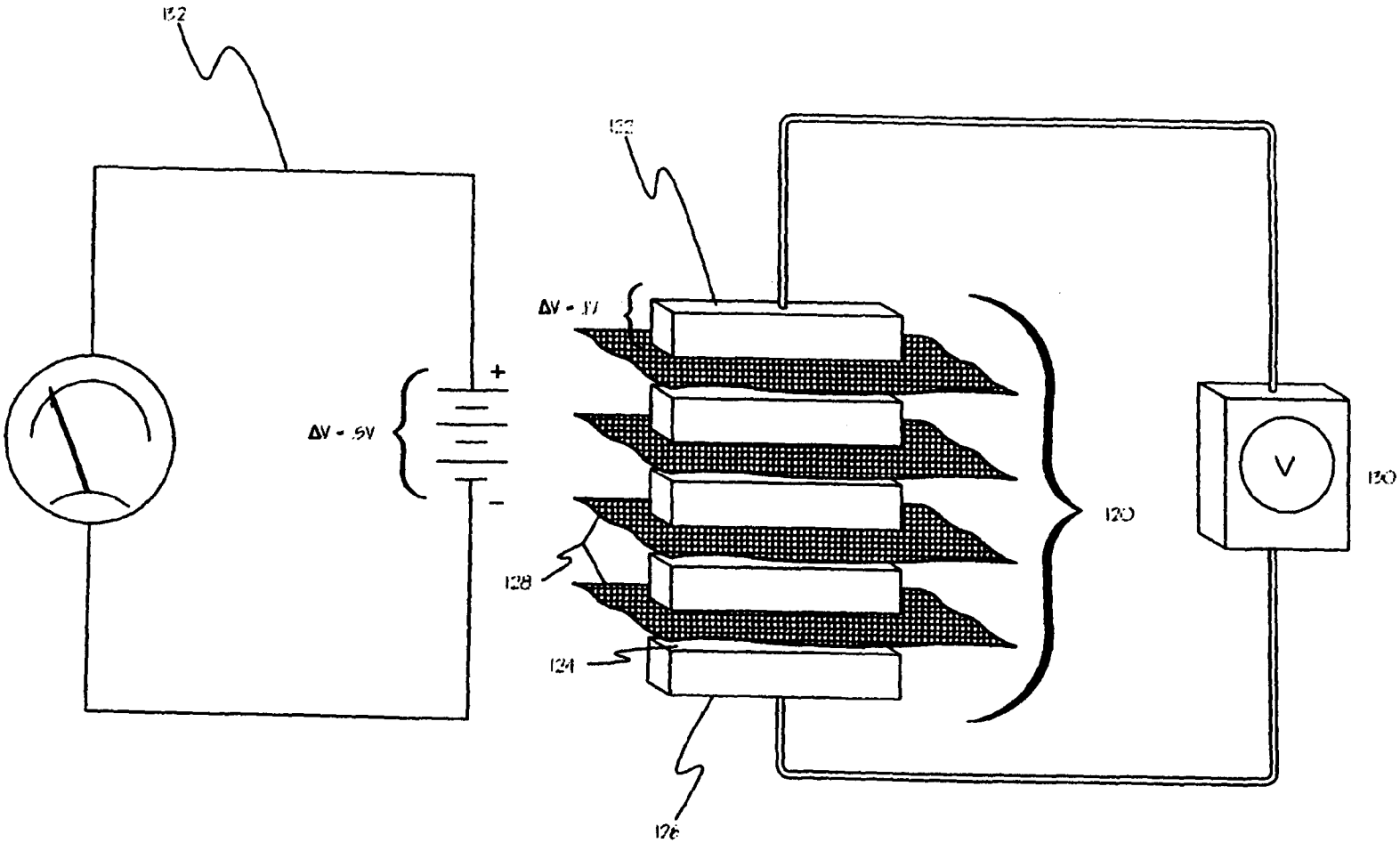
FIG. 4 is a perspective view of a battery created utilizing the method of the present invention.

FIG. 4 is a perspective view of a battery 120 constructed utilizing the method of the present invention. The creation of a battery 120 from materials treated according to the method of the method of the present invention demonstrates the existence of the galvanic couple between the higher cold worked surface 102 and the lower cold worked surface 104 as evidenced by the potential difference or voltage which develops across the terminals of the battery. The battery 120 consists of 7075-T6 aluminum plates 122 with different surface treatments applied to the top surface 124 and bottom surface 126 of each plate 122. The top surface 124 of each aluminum plate 122 was electro-polished, resulting in 0% cold work at the surface, while the bottom surface 126 of each plate 122 was heavily shot peened resulting in approximately 30% cold work at the surface. With this configuration, the less noble, higher cold worked surface behaves as an anode as it has a lower corrosion potential compared to the more noble, lower cold worked surface, which, behaves as a cathode.

Referring to FIG. 4, the battery 120 is created by stacking a series of plates 122, in this case five plates, such that higher cold worked bottom surfaces 126 are in opposition to the lower cold worked top surfaces 124. Disposed between each plate 122 is a filter paper 128 or similar medium saturated with a salt-water solution that acts as the electrolyte in the corrosion reaction and provides an electronic connection between the top and bottom surfaces. The difference in the corrosion potential, which is approximately 0.1 volt across each pair of lower and higher cold worked surfaces, is a result of the relative nobility of the two surfaces due to the different levels of cold working. The oxidation reaction taking place as the higher cold worked surface corrodes supplies electrons that contribute to the reduction reaction taking place at the low cold worked surface thus resulting in a measurable current through the battery 120. A voltmeter 130 placed across the battery 120 registered a potential drop across the arrangement of 0.5 volts. An equivalent circuit 132 is shown.

Figure 5:
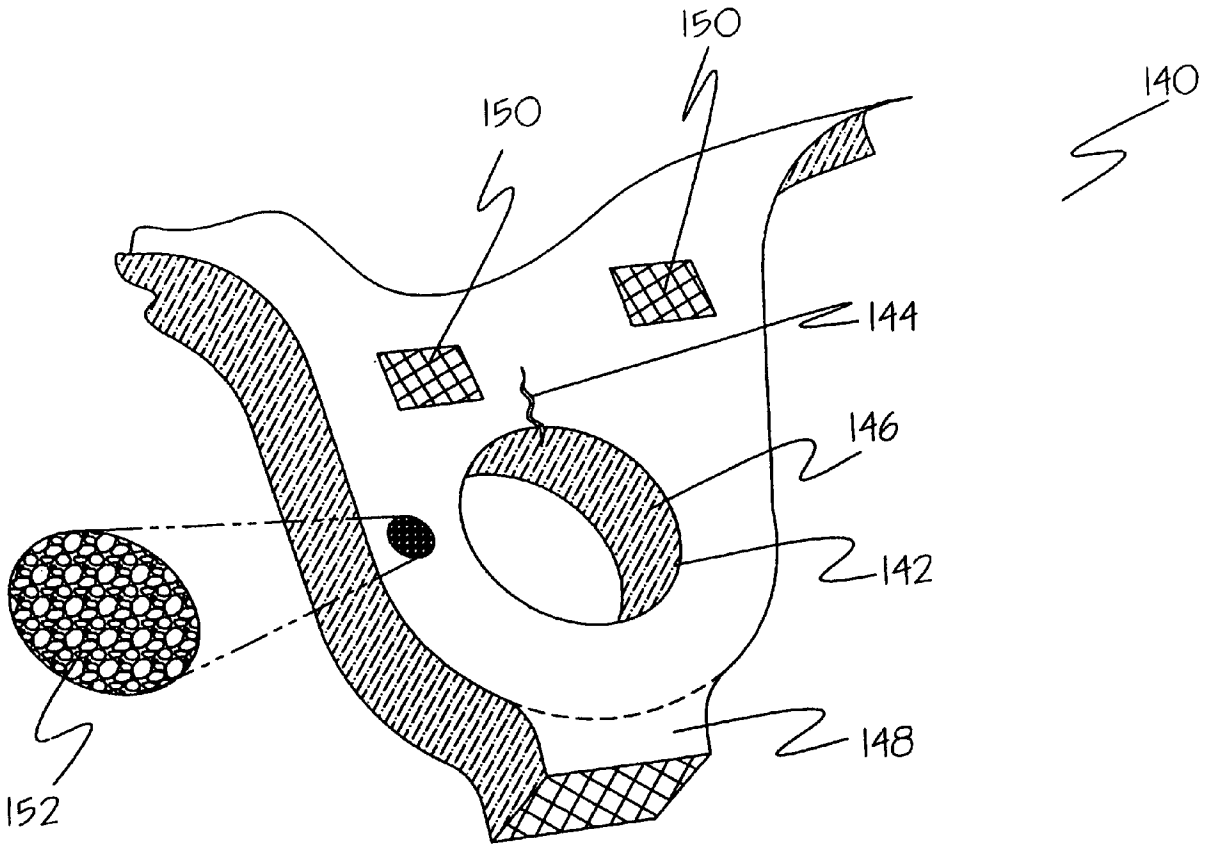
FIG. 5 is a perspective view of a metallic article, specifically a lug structure, protected against corrosion damage and fatigue according to the method of the present invention.

FIG. 5 shows a metallic article 140, in this case a lug structure, composed of a single metal or alloy. The metallic article 140 is susceptible to fatigue cracking exacerbated by the presence of corrosion damage. The inner diameter 142 of the article 140 is subject to high-applied stresses, which after extensive cyclic loading, leads to the development of fatigue cracks 144. The surface of the article, including the surface 146 of the inner diameter 142, is also susceptible to gross corrosion. The presence of corrosion damage 152, such as corrosion pits, reduces the fatigue life of the structure as the corrosion damage 152 serves as stress risers or stress concentrators from which fatigue cracks 144 may develop and propagate.

The method of the present invention can be used to mitigate the impact of corrosion on fatigue life while improving the resistance to fatigue failure and stress corrosion cracking of the metallic article in the following manner. The surface 146 of the lug structure 140, which is susceptible to both fatigue cracking and corrosion, is treated with a first surface enhancement to induce compressive residual stresses that offset the applied stresses, as well as any tensile residual stresses, thereby mitigating the effects of fatigue. The first surface enhancement also induces a specified, controlled amount of cold work in the surface 146. Should the metallic article 140 contain multiple areas susceptible to both corrosion and fatigue failure, the first surface enhancement may be applied to each of those areas to induce compressive residual stress with a controlled amount of cold work.

A second surface enhancement is used to treat one or more sacrificial areas 150 of the lug structure. The sacrificial areas 150, which are in electrical communication with the surface 146 treated by the first surface enhancement, are susceptible to corrosive attack but not susceptible to high-applied stresses or fatigue failure. Alternatively, the sacrificial areas 150 may be less susceptible to fatigue failure than the surface (now "protected" surface) 146. The second surface treatment induces a specified level of cold work in the sacrificial areas 150 such that the level of cold work induced by the second surface treatment is greater than the level of cold work induced by the first surface treatment at the protected surface 146 of the lug structure 140. A galvanic couple is thereby established between the areas.

The galvanic couple between the sacrificial areas 150 and the protected surface 146 is due to the different corrosion potentials associated with the levels of cold work resulting from each of the first and second surface treatments. The protected surface 146 is thereby cathodically protected from corrosive attack while the sacrificial areas 150 preferentially corrode. Further, the compressive residual stress induced in the protected surface 146 and the sacrificial areas 150 improves the resistance of the lug 140 to both fatigue failure and stress corrosion cracking.

A variety of surface treatments may be used to induce both the compressive residual stress and cold work in the component including burnishing, low plasticity burnishing, deep rolling, laser shock peening, shot peening, impact peening, pinch peening, cavitation peening, indenting or any other method capable of inducing compressive residual stress with a controlled amount of cold work.

By way of example, the fatigue and corrosion susceptible surface 146 may be treated by low plasticity burnishing or laser shock peening, thereby inducing a compressive residual stress with a corresponding low amount of cold work. To produce the galvanic couple and thereby provide the necessary protection, the second, sacrificial area 150 is shot peened or impact peened to induce a comparatively higher amount of cold work at the fatigue and corrosion susceptible surface 146. This mitigates corrosion at the corrosion susceptible surface 146 and promotes corrosion at the sacrificial area 150.

In another embodiment, a sacrificial area 150 may be located on a sacrificial feature 148, such as extra material incorporated in the design of, and electrically connected to, the structure being protected. With the application of a higher cold work surface treatment, the sacrificial feature 148 will preferentially corrode leaving the remainder of the article protected from corrosive attack.

In another embodiment, the corrosion protection provided by the method is renewed by cleaning or otherwise removing corrosion bi-products from the sacrificial areas 150 and re-applying the second surface treatment to increase or replenish the level of cold work in the sacrificial areas 150.

The surface treatment method of the present invention can be used to treat a variety of conductive metallic structures and components subject to corrosive attack and stress related failure mechanisms such as fatigue, corrosion fatigue, and stress corrosion cracking. This includes, but is not limited to, aircraft, naval and ground-based turbines including steam turbines, aircraft structural components, aircraft landing gear and components, metallic weldments, piping and components used in nuclear, fossil fuel, steam, chemical, and gas plants, distribution piping for gases and fluids, automotive components such as gears, springs, shafts, connecting rods, and bearings, ship hulls, propellers, impellers, and shafts, rail transport components and tracks, and various other components and structures too numerous to be mentioned herein.

The previously described versions of the invention have many advantages, including providing a method for controlling and mitigating the occurrence of corrosion while simultaneously providing an improvement in the ability of a component or structure to withstand stress related failures such as fatigue and stress corrosion cracking. Previous technologies and techniques required disparate treatments to separately mitigate the effects of corrosion and fatigue.

Another advantage of the current invention is that it provides a method for galvanically or cathodically protecting a metallic article from corrosive attack without the use of dissimilar metals, an impressed current, or an external current source as is generally required for galvanic or cathodic protection. Instead, the current invention relies on a galvanic couple created by mechanical surface treatments and thus does not require the addition of any material to the protected structure nor does it require the attachment of any external material or equipment to the protected structure.

Further, the method provides a metallic article with protection against corrosive attack without the use of barrier treatments, such as painting, plating or coating the protected structure, thus eliminating the potential health and environmental risks associated with such operations. The method of the current invention is not susceptible to damage, such as cracking and chipping, and thus represents an improvement over painted, coated or plated surfaces susceptible to such damage by decreasing operation and maintenance costs for the protected article.

Another advantage of the method of the present invention is that the method can be easily incorporated into existing systems and structures, such as aging aircraft, without the associated expense of adding new materials or changing existing materials. Further, the method of the present invention can be easily incorporated into a manufacturing environment as the method can be performed as an additional machining or treatment operation.

Although the present invention has been described in considerable detail with reference to certain preferred embodiments thereof, other embodiments are possible. Therefore, the scope of the appended claims should not be limited to the description of the preferred embodiments contained herein.

What is claimed is:

1. A metallic article comprising:

at least one protected area resistant to corrosive attack;

at least one sacrificial area disposed to corrosion;

the at least one sacrificial area being in electrical communication with the at least one protected area and having an amount of cold work greater than the protected area such that the protected area is more noble than the sacrificial area and wherein said at least one protected area and said at least one sacrificial area are formed from the same metallic material.

2. The metallic article of claim 1 wherein the at least one protected area has no cold work.

3. The metallic article of claim 1 wherein the at least one protected area has less cold work than in the at least one sacrificial area and is less resistant to corrosion than the at least one protected area.

4. The metallic article of claim 1 wherein the surface of at least one sacrificial area has been cold worked by one or more surface enhancements for inducing compressive residual stress in the surface of the workpiece.

5. The metallic article of claim 4 wherein the surface enhancements are selected from the list consisting of shot peening, laser shock peening, deep rolling, burnishing, low plasticity burnishing, cavitation peening, controlled impact peening, pinch peening, indenting and/or combinations thereof.

6. The metallic article of claim 1 wherein the resistance to corrosive attack of the at least one protected area is renewed by further cold working the at least one sacrificial area.

7. The metallic article of claim 1 wherein the at least one sacrificial area is formed with additional material such that corrosion of the at least one sacrificial area will not adversely impact the strength and integrity of the metallic article.

8. A metallic article comprising:

at least one protected area resistant to corrosive attack, the protected area having compressive residual stress and an amount of cold work induced therein;

at least one sacrificial area in electrical communication with the protected area and containing an amount of cold work greater than the protected area.

9. The metallic article of claim 8 wherein the at least one protected area is more resistant to fatigue, corrosion fatigue and stress corrosion cracking due to compressive residual stresses accompanying the induced cold work than the at least one sacrificial area.

10. The metallic article of claim 8 wherein the at least one sacrificial area has been cold worked by the application of one or more surface enhancements for inducing compressive residual stress in the surface of a workpiece.

11. The metallic article of claim 8 wherein the surface enhancements are selected from the list consisting of shot peening, laser shock peening, deep rolling, burnishing, low plasticity burnishing, cavitation peening, controlled impact peening, pinch peening, indenting and/or combinations thereof.

12. The metallic article of claim 8 wherein the resistance to corrosive attack of the at least one protected area has been increased by inducing additional cold work in the at least one sacrificial area.

* * * * *